US005305932A

United States Patent [19]

Iseli

[11] Patent Number: 5,305,932

[45] Date of Patent: Apr. 26, 1994

[54] PERMANENT SNAP-ON, TWIST-OPEN CAP AND CONTAINER

[75] Inventor: Andreas Iseli, Downey, Calif.

[73] Assignee: Seda International Plastics, Los Angeles, Calif.

[21] Appl. No.: 47,995

[22] Filed: Apr. 19, 1993

[51] Int. Cl.[5] ..... B65D 47/28

[52] U.S. Cl. ..... 222/521

[58] Field of Search ..... 222/519-521, 222/524, 525

[56] References Cited

U.S. PATENT DOCUMENTS

| | | | |
|---|---|---|---|
| 2,808,169 | 10/1957 | Gruber | 222/521 |
| 3,010,619 | 11/1961 | Gronemeyer | 222/521 |
| 3,123,259 | 3/1964 | Musel et al. | 222/521 |
| 3,370,764 | 2/1968 | Stull | 222/521 X |
| 3,738,545 | 6/1973 | Roy | 222/525 |
| 3,981,421 | 9/1976 | McDowell, Jr. et al. | 222/521 |
| 4,477,002 | 10/1984 | Stull | 222/521 |
| 4,823,994 | 4/1989 | Laauwe | 222/521 |
| 4,964,548 | 10/1990 | Kenyon, Jr. | 222/521 |
| 5,189,369 | 2/1993 | Aguirrezabal | 222/521 |

*Primary Examiner*—Kevin P. Shaver
*Attorney, Agent, or Firm*—Plante, Strauss & Vanderburgh

[57] ABSTRACT

There is disclosed a press on dispensing cap for containers which can be opened and closed by a limited angular rotation. The cap is press fitted onto the neck of a container such as a tube, and the neck of the container has a plurality of discontinuous spiral tracks which receive lugs carried on an inner skirt of the cap to permanently retain the cap, and to permit extension and retraction of the cap upon twisting. Preferably the lugs have a plurality of closely spaced ribs on their inside surface which ride against the neck wall, thereby reducing the frictional resistance of the cap to rotation. The cap has a dispensing orifice which seals about a central boss on the end of the neck, and two additional seals which engage against sealing surfaces of the tube neck. One seal is a circular rim on the underside of the cap which seals against a circular rim on the end of the neck, opposed to that on the cap. Another seal is an annular lip on the inside wall of the skirt of the cap which slides against the neck of the tube.

12 Claims, 3 Drawing Sheets

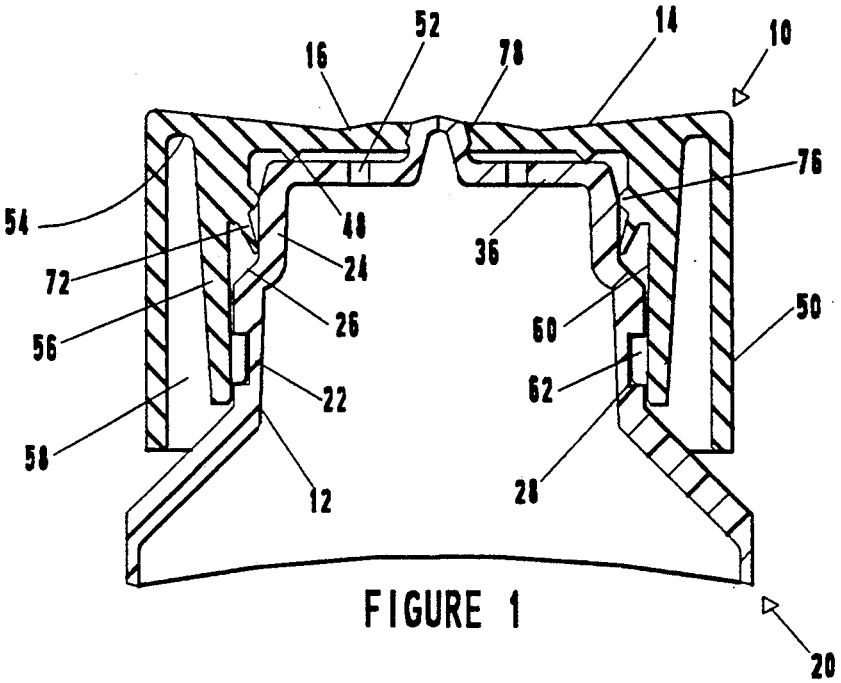
FIGURE 1
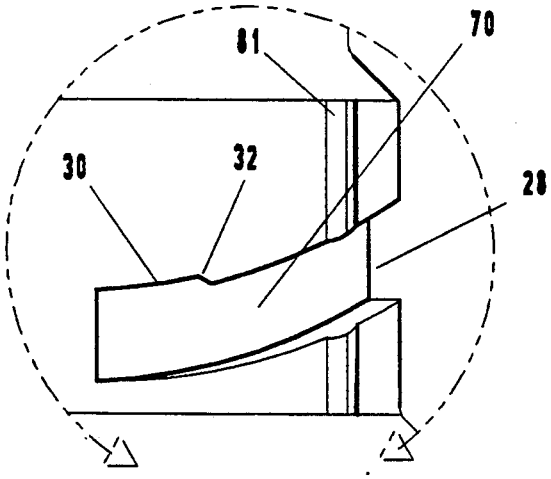
FIGURE 6
FIGURE 7
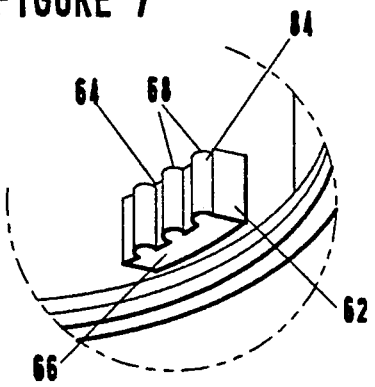

PERMANENT SNAP-ON, TWIST-OPEN CAP AND CONTAINER

BACKGROUND OF INVENTION

1. Field of The Invention

This invention relates to a dispensing cap which is particularly well suited for use on tubes of cream, gel or lotion.

2. Brief Statement Of The Prior Art

Plastic dispensing caps for containers such as plastic and glass bottles and plastic tubes are well established products with many years of development and commercial use. An early dispensing cap is shown in U.S. Pat. No. 1,614,077 which discloses the use of a lug on the inside wall of the skirt of the cap which is captured in a partial helical groove in a container neck. U.S. Pat. No. 3,263,851 shows a screw cap with a pair of locking beads 21 and 31 which prevent removal of the cap, with the upper edge of the neck of the container being contoured to seal against the conical undersurface of the cap, and a bead to seal against the container neck. U.S. Pat. No. 3,319,843 shows a screw cap which is removable and has only a single seal. U.S. Pat. No. 4,927,065 shows an adjustable metering closure cap which provides at least two different dispensing or metering rates by dispensing slots of varied length, or stepped shoulders, or V-shaped slots. U.S. Pat. No. 4,823,994 discloses a two-piece closure for bottles which has a skirt 10 having integral protuberances which engage screw threads of the base piece. The top piece has a center skirt which seals against the inner surface of an upstanding tubular extension of the base. U.S. Pat. No. 4,964,548 discloses a dispensing disclosure having an interior sealing sleeve, an outer threaded sleeve engaging a threaded tube, and stop locks limiting the twisting of the closure cap. U.S. Pat. No. 4,967,941 discloses a twist lock adjustable metering closure cap having a ring seal which bears against the interior surface of the top wall portion of the cap body 12. U.S. Pat. No. 4,477,002 discloses a dispensing screw cap having double seals which are provided by beads on the cap. One problem which has not been satisfactorily solved is a press on dispensing cap which has adequate seals to prevent leakage of contents of the container.

OBJECTIVES OF THE INVENTION

It is an objective of this invention to provide a dispensing cap as a closure for containers of liquids and pastes.

It is also an objective of this invention to provide a dispensing cap which opens and closes upon twisting through a limited angular displacement.

It is an additional objective of this invention to provide a dispensing cap which has a plurality of seals to prevent leakage of the contents of a container.

It is a further objective of this invention to provide a dispensing cap which has bearing surfaces of limited area to permit ease of operation.

It is likewise an objective of this invention to provide a dispensing cap which is permanently seated on the neck of a container.

It is another objective of this invention to provide a dispensing cap which is ideally suited for use with tubes of cream or lotion.

Other and related objectives will be apparent from the following description of the invention.

BRIEF STATEMENT OF THE INVENTION

This invention is a press on dispensing cap for containers which can be opened and closed by a limited angular rotation. The cap is press fitted onto the neck of a container such as a tube. The neck has a plurality of discontinuous spiral tracks, and the cap has a skirt with a like plurality of lugs on its inner surface for engagement in the spiral tracks, whereby twisting the cap extends or retracts it on the central boss of the tube. Preferably the neck has a plurality of axial ribs about its periphery to form bearing surfaces on which the inside surface of the cap can ride, thereby reducing the frictional resistance of the cap to rotation. The cap has a dispensing orifice which seals about a central boss on the end of the neck, and two additional seals which engage against sealing surfaces of the tube neck. One seal is a circular rim on the underside of the cap which seals against the end of the neck. Another seal is an annular lip on the inside wall of the skirt of the cap which slides against the neck of the tube. The cap is permanently seated on the container such as a tube.

DESCRIPTION OF THE DRAWINGS

The invention will be described with reference to the figures of which:

FIG. 1 is an elevational cross section view of the cap of the invention in a closed position on a container neck;

FIG. 6 is an enlarged view of the area within line 6—6' of FIG. 4;

FIG. 7 illustrates an alternative structure for bearing surfaces between the cap and the container.

DESCRIPTION OF THE PREFERRED EMBODIMENT

The invention is a cap and container neck therefor which is particularly well suited for use with dispensing squeeze tubes filled with viscous liquids such as creams and lotions. The cap 10 and container neck 12 are shown in elevational sectional views in FIGS. 1 and 2, in the closed and open positions, respectively.

Figure 2:
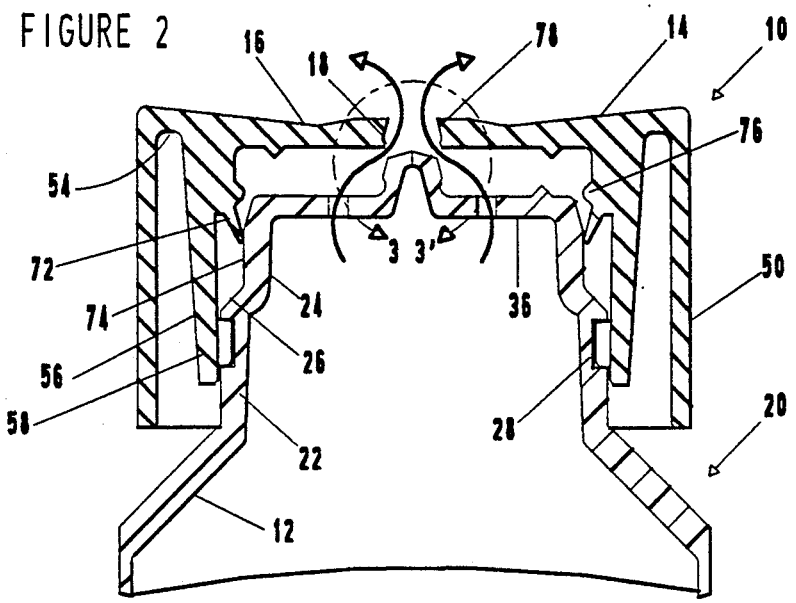
FIG. 2 is an elevational cross section view of the cap of the invention in an open position on a container neck.
Figure 4:
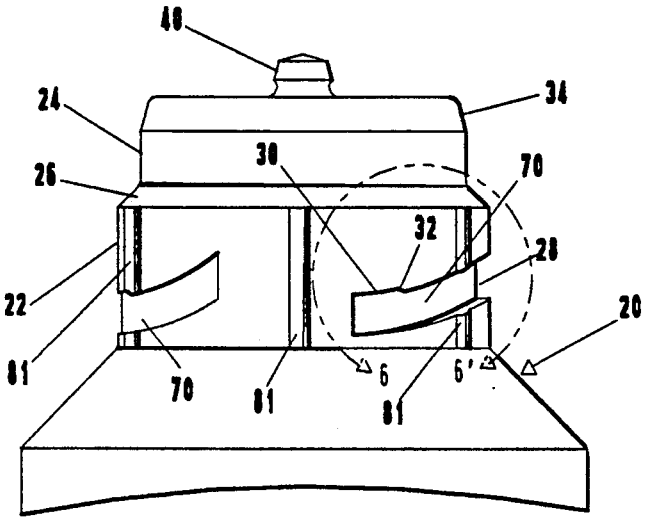
FIG. 4 is an elevational view of the container neck used with the cap of the invention.

The cap 10 of the invention has a circular, disk shaped top 14, preferably slightly dished with a central recessed area 16 and a central aperture 18 which is preferably coaxial with the axis of the container 20. As shown in FIGS. 1 and 2, the container 20 has a neck 12 of lesser diameter than that of the main body of the container 20. The cap 10 can be used on various containers, however, it is particularly suited for use on a squeeze tube. The neck 12 has a base 22 of right cylinder configuration with an upper portion 24 of reduced diameter and an inclined shoulder 26 between the base 22 and upper portion 24. As shown in FIG. 4, the base 22 of the neck 12 has a plurality of discontinuous helical grooves 28 which are shown in an enlarged view in FIG. 6. The grooves 28 are slightly enlarged at their lowermost ends 30 with a tapered shoulder 32 between the enlarged portion and the remainder of the groove.

In the illustrated embodiment three such discontinuous helical grooves 28 are provided at equal angular increments (120 degrees). The base 22 of the neck also has a plurality of axial ribs 81 which are spaced about the neck at equal angular increments, e.g., at 60 degree angular increments. These ribs are slightly raised above the cylindrical surface of the base 22 of neck 12 so that they provide bearing surfaces of greatly reduced surface area for the cap 10.

Figure 3:
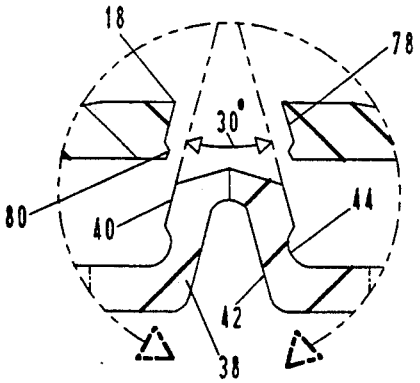
FIG. 3 is an enlarged view of the area within line 3—3' of FIG. 2.

The upper portion 24 of the neck 12 is also of right cylindrical configuration and, preferably, has a slightly conical upper edge 34 with an included cone angle of approximately 30°. The surface of the top 36 of the neck 12 is planar (see FIGS. 1 and 2) and bears a center post 38 that is best illustrated in the enlarged view shown in FIG. 3. As there illustrated, the post 38 is of a generally conical configuration with exterior walls 40 at an included cone angle of from 20° to 40°, preferably 30°. The base 42 of the post 38 is undercut with a groove 44, and the upper end 46 of the post is conical with an obtuse included conical angle.

A circular rib 48 of triangular cross section is provided on the surface of the top 36 of the neck 12 to form a ring seal about the end of the tube. A plurality of apertures 52 for discharge of the contents of the container are provided through the top 36 of the neck 12, preferably spaced at equal angular increments about the center post 38. When the cap is open, as shown in FIG. 2, the solid arrowhead lines show the direction of flow from the container to discharge from the cap.

The cap 10 of the invention has an outer, right cylindrical skirt 50 which depends from the undersurface 54 of the outer periphery of the disk-shaped top 14. The exterior configuration of skirt 50 can be varied as desired for appearance and for ease of gripping, e.g., can be serrated, grooved, etc., or can be of a tapered or conical overall shape.

Figure 5:
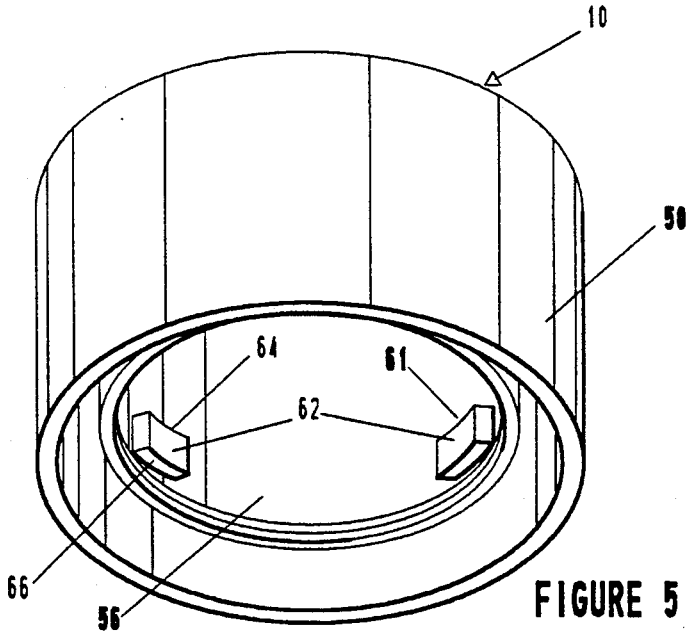
FIG. 5 is a perspective view of the underside of the cap of the invention.

An inner skirt 56 of a general cylindrical configuration also depends from the undersurface 54 of the cap top 14. Preferably, the outer sidewall 58 of the inner skirt is slightly conical, converging between the upper and lower edges at a very slight angle, e.g., less than 10° and preferably less than 5°. This surface is preferably smooth, as illustrated, and the inner surface 60 of the inner skirt 56 supports a plurality of lugs 62 which are arranged at equal angular increments about the inner peripheral edge of the inner skirt 56. As shown in FIG. 5, these lugs are spaced preferably at 20° increments with three lugs 62 spaced about the periphery of the inner skirt 56. Preferably these lugs are inclined and have curved upper and lower surfaces 64 and 66, corresponding to the curvature of the top and bottom edges of the discontinuous helical grooves 28 in the neck 12 (see FIG. 3), and are inclined at the same angle as those grooves. The inside surface of inner skirt 56 rides against the axial ribs 81 on the base 22 of neck 12; see FIGS. 4 and 6.

The upper shoulders 61 of the lugs 62 are substantially square to lock permanently within the grooves 28 of the neck. A slight angle is provided, e.g., the angle of the top and under surfaces of the lug to the side surface of the neck can be an angle which is slightly less than a right angle, for production reasons, to permit ease in separation from the manufacturing mold, and this is considered to be substantially square. The shoulders 61 of the lugs, however, are still sufficiently square that the lugs become permanently captured when seated in the grooves 28. The conical upper edge 26 of the neck (see FIG. 4) serves as a feed ramp for the lugs 62 to spread the inner skirt 56 sufficiently to permit the lugs to snap into the grooves 28 in the neck.

As illustrated in FIG. 7, a structure is shown which is alternative to the use of axial ribs 81. FIG. 7 is an enlarged view of a lug 62 and shows that the inner surface of the lug has a plurality of upstanding ribs 68 which provide bearing surfaces of significantly reduced engagement area for bearing against the inner vertical surfaces 70 (see FIG. 4) of the discontinuous helical grooves 28. In this structure, the lugs 81 would be omitted from base 22 of neck 12.

The inner skirt 56 also supports sealing means about the top portion of its inner surface of the inner skirt. A flexible lip seal 72 of a generally conical shape is provided, and this seal 72 resiliently engages against the right cylindrical surface 74 of the upper portion 24 of the neck 12 in both the closed and open positions, shown in FIGS. 1 and 2. A sealing bead 76 is also provided on the inner surface 60 of the inner skirt 56, slightly above the aforementioned flexible lip 72 and, as shown in FIG. 1, this bead 76 also resiliently seals against the right cylindrical surface 74 of the neck 12 when the cap is in its recessed, closed position. When the cap 10 is closed, as shown in FIG. 1, three independent seals, circular rib 48, bead 76 and lip seal 72, provide sufficient sealing to prevent leakage of contents of the container, even when the internal pressure of the tube exceeds the outside pressure, e.g., when the tube becomes heated in the sunlight, or the outside pressure is reduced when the tube is carried to a higher altitude or stored in the baggage space of an aircraft.

The cap 10 of the invention has a central dispensing aperture 78 which is closed by the central post 38 of the neck to seal the contents of the container when the cap is recessed, as shown in FIG. 1. For this purpose, the central aperture 78 of the cap 10 has a lower annular lip 80 that will seat in the undercut groove 44 of the post 38; see FIG. 3. Preferably, the aperture 78 has sidewalls which are inclined at the same included conical angle as the conical portion of the central post 38 for effective sealing in the closed position as shown in detail in FIG. 3.

As shown in FIG. 5, each sealing lug 62 has a plurality of upstanding ribs 68 having a generally arcuate cross sectional area along its inner surface. These ribs function as bearing contacts for engagement with the opposed inside wall of the discontinuous helical grooves 28 in which each of the lugs is inserted. Preferably, the lugs 62 have square outer shoulders 84 whereby when the cap is seated on the neck of the container it is permanently mounted thereon and does not readily disengage.

As apparent from the preceding discussion of the invention, the cap of the invention functions with movement between complete open and complete closed positions with a fractional rotational movement, i.e., approximately 90°. Rotation of the cap will extend the cap moving it from the position shown in FIG. 1 to the open position shown in FIG. 2. In the open position, the contents of the container can be dispensed through one or more apertures 52 in the top of the central boss, into an annular chamber between the cap and the top plate of the boss from which the contents are extruded through the central aperture of the cap. In this configuration, the annular dispensing chamber is sealed by the flexible conical lip seal which prevents leaking of the container contents around the bottom peripheral surface of the cap. When the cap is closed, the contents are sealed since the annular chamber, now decreased in size, is sealed by the engagement of the central aperture of the cap about the central post, a seal which is reinforced by the snap action of the annular lip seating in the undercut groove of the central post. The annular chamber is also sealed by a triangular bead on the undersurface of the cap top which seals against the upper surface of the central post. Further, the contents are sealed against leakage along or about the bottom periphery of the cap by the triangular shaped annular bead and the flexible lip seal.

The cap of the invention is permanently seated on its container. A useful method for forming the container is that shown in U.S. Pat. No. 4,943,405, in which a hot plastic dose is deposited onto a support of the mold and compression molded about a mandrel forming the container neck and a generally cylindrical tube.

Figure 8:
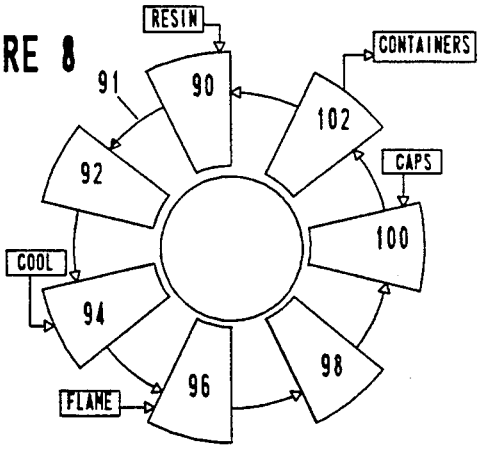
FIG. 8 is a block diagram showing the steps in manufacture of a container and application of the cap.

FIG. 8 illustrates the manufacturing steps for the containers and the application of the caps. The plastic dose is deposited in the mold in step 90, the container tube is molded in step 92, and the tube and supporting mandrel are then moved to a cooling station 94. The movements between the stations are represented by arrowhead line 91. The finished cold tube is loaded on a mandrel of a second machine and is moved to a surface treatment station 96 where flame treatment or other treatments are applied to prepare the outer surface of the tube for printing, then to a printing station 98. The printed tube and mandrel is moved to the cap application station 100. The preformed cap is supplied to the capping station 100 where it is forced onto the neck of the tube by an axial compression force. Since the tube is still supported on the mandrel, sufficient axial force can be applied to seat the engagement lugs of the cap in their respective discontinuous helical tracks of the neck. In the next station (not shown), the cap is torqued to confirm that the cap seats in its closed position shown in FIG. 1. After the cap is seated, the tube with its assembled cap is passed to a discharge station 102, where it is removed from the mandrel for subsequent filling through its open lower end. After filling, the lower end of the tube is then permanently sealed by thermal or solvent welding.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A dispensing cap and container with a tubular body for liquid and semi-solids which container includes a cylindrical neck base of lesser diameter than said body and having at least one partial helical groove, an upper portion of reduced diameter with an outer axial wall and a frustro-conical upper edge, and a planar neck top broken with aperture means and an orthogonal post centrally located on said neck top, which comprises:

a) a dish-shaped cap top having a central aperture with an annular lip thereabout for registration with said post;

b) a cylindrical skirt dependent from said cap top about its outer edge;

c) a second, inner skirt, dependent from the undersurface of said cap top;

axially inclined lug means dependent on the inner surface of said second, inner skirt at a location to cooperatively seat in each of said partial helical grooves to permit extension and retraction of said cap upon rotatable movement thereof;

e) seal means about the bottom edge of said central aperture for sealing engagement with said central post; and f) an inwardly directed flexible lip seal about the inner wall of said second, inner skirt and undercut on its outer surface to impart flexibility thereto, and being to impart flexibility thereto, and being of sufficient diameter to be received over said fustroconical upper edge and to be resiliently expanded into a seal against the outer axial wall of said upper portion of said neck.

2. The cap and container of claim 1 including an annular bead about the inner wall of said second, inner skirt above said flexible lip seal and of sufficient diameter to seal against the axial wall of said upper portion of said neck.

3. The cap and container of claim 1 wherein said dish-shaped cap top has a recessed, central surface.

4. The cap and container of claim 1 wherein said seal means includes an undercut groove in said central post which yieldingly receives said annular lip about said central aperture.

5. The cap and container of claim 1 including a plurality of axially aligned ribs on an exterior surface of said cylindrical neck base.

6. The cap and container of claim 1 wherein said lug means and said helical groove have square shoulders, whereby said cap is permanently retained on said container; and said neck has a conical transition between said upper portion and base portion to provide a ramp to spread the inner skirt sufficiently to permit said lug means to snap into said partial helical groove during assembly of said cap and container.

7. The cap and container of claim 6 including at least two of said grooves and at least two coacting lug means.

8. A cap and container for liquids and semi-solids which includes a reduced diameter cylindrical neck having at least one partial helical groove and a planar neck top broken with aperture means and an orthogonal post centrally located on said neck top, which comprises:

a) a dish-shaped cap top having a central aperture for registration with said post;

b) a cylindrical skirt dependent from said cap top about its outer edge;

c) a second, inner skirt, dependent from the undersurface of said cap top;

axially inclined lug means dependent on the inner surface of said second, inner skirt at a location to cooperatively seat in each of said partial helical grooves to permit extension and retraction of said cap upon rotatable movement thereof; and e) seal means including a lip seal about the bottom edge of said central aperture for sealing engagement with said central post including an undercut groove in said central post which yieldingly receives said lip seal.

9. The cap and container of claim 8 wherein the upper end of said central post has a fustro-conical surface.

10. A cap and container for liquids and semi-solids which includes a reduced diameter cylindrical neck having at least one partial helical groove and a planar neck top broken with aperture means and an orthogonal post centrally located on said neck top, which comprises:

a) a dish-shaped cap top having a central aperture for registration with said post;

b) a cylindrical skirt dependent from said cap top about its outer edge;

c) a second, inner skirt, dependent from the undersurface of said cap top;

axially inclined lug means dependent on the inner surface of said second, inner skirt at a location to cooperatively seat in each of said partial helical grooves to permit extension and retraction of said cap upon rotatable movement thereof and a plurality of axially aligned ribs on the inner surface of said lug means; and e) seal means including a lip seal about the bottom edge of said central aperture for sealing engagement with said central post.

11. A cap and container for liquids and semi-solids which includes a reduced diameter cylindrical neck having at least one partial helical groove and a planar neck top broken with aperture means and an orthogonal post centrally located on said neck top, which comprises:

a) a dish-shaped cap top having a central aperture for registration with said post;

b) a cylindrical skirt dependent from said cap top about its outer edge;

c) a second, inner skirt, dependent from the undersurface of said cap top;

axially inclined lug means dependent on the inner surface of said second, inner skirt at a location to cooperatively seat in each of said partial helical grooves to permit extension and retraction of said cap upon rotatable movement thereof and a plurality of axially aligned ribs on an exterior surface of said cylindrical neck base; and e) seal means including a lip seal about the bottom edge of said central aperture for sealing engagement with said central post.

12. The cap and container of claim 11 wherein said seal means includes an undercut groove in said central post which yieldingly receives said annular lip about said central aperture.

* * * * *